US010480235B2

(12) United States Patent
Zaccaria

(10) Patent No.: US 10,480,235 B2
(45) Date of Patent: Nov. 19, 2019

(54) LEAF UNIT OF A SCISSOR MECHANISM OF A FITTING AND METHOD FOR INSTALLING SUCH A LEAF UNIT

(71) Applicants: WILH. SCHLECHTENDAHL & SÖHNE GMBH & CO. KG (WSS), Heiligenhaus (DE); SAPA AS, Oslo (NO)

(72) Inventor: Giovanni Zaccaria, Leinfelden Echterdingen (DE)

(73) Assignees: WILH. SCHLECHTENDAHL & SÖHNE GMBH & CO. KG (WSS), Heiligenhaus (DE); SAPA AS, Oslo (NO)

( * ) Notice: Subject to any disclaimer, the term of this patent is extended or adjusted under 35 U.S.C. 154(b) by 131 days.

(21) Appl. No.: 15/662,856

(22) Filed: Jul. 28, 2017

(65) Prior Publication Data

US 2018/0030769 A1 Feb. 1, 2018

(30) Foreign Application Priority Data

Aug. 1, 2016 (EP) ..... 16001693

(51) Int. Cl.
*E05D 15/30* (2006.01)
*E05D 15/52* (2006.01)
(Continued)

(52) U.S. Cl.
CPC ..... *E05D 15/30* (2013.01); *E05D 15/52* (2013.01); *E05D 15/523* (2013.01); *E05D 15/28* (2013.01);
(Continued)

(58) Field of Classification Search
CPC ..... E05Y 2800/68; E05Y 2800/684; E06B 2003/6223
(Continued)

(56) References Cited

U.S. PATENT DOCUMENTS 2,784,459 A * 3/1957 Anderberg ..... E05D 15/30 16/341
3,345,777 A * 10/1967 Anderberg ..... E05D 15/00 16/341
(Continued)

FOREIGN PATENT DOCUMENTS

CA 2974641 A1 * 2/2018
DE 10201411289 A1 * 3/1916
(Continued)

OTHER PUBLICATIONS 7 page machine translation of EP 0 592 777. Translated Mar. 23, 2019. (Year: 1993).*

*Primary Examiner* — Robert Canfield
(74) *Attorney, Agent, or Firm* — Im IP Law; C. Andrew Im; Chai Im

(57) ABSTRACT

A leaf unit of a scissor mechanism of a fitting for a leaf of a window or of a door, insertable into a C-shaped leaf groove in the rebate of a leaf profile of the leaf is provided. The leaf unit includes a scissor guide fastenable on the leaf and a scissor rod moveable relative to the scissor guide in the operating state. The scissor rod is movable between a closed position and a tilt position relative to the scissor guide in the operating state. The scissor guide and the scissor rod are pre-fixed for insertion into the leaf groove in a pre-installation position which is between the closed position and the tilt position.

18 Claims, 11 Drawing Sheets

(51) Int. Cl.
*E05D 15/523* (2006.01)
*E06B 3/62* (2006.01)
*E05D 15/28* (2006.01)

(52) U.S. Cl.
CPC . *E05Y 2800/684* (2013.01); *E06B 2003/6223* (2013.01)

(58) Field of Classification Search
USPC ..... 49/192, 193, 246, 248
See application file for complete search history.

(56) References Cited

U.S. PATENT DOCUMENTS 4,420,905 A * 12/1983 Kucharczyk ..... E05C 9/002 292/139
7,017,301 B2 * 3/2006 Balbo Di Vinadio .... E05C 9/20 49/192
7,644,538 B2 * 1/2010 Balbo Di Vinadio .. E05C 9/063 49/192
7,752,809 B2 * 7/2010 Di Vinadio ..... E05D 15/5208 292/32
7,913,456 B2 * 3/2011 Balbo Di Vinadio .. E05C 9/021 29/270
8,161,683 B2 * 4/2012 Van Parys ..... E05D 15/52 292/141
2008/0016774 A1 * 1/2008 Vinadio ..... E05C 9/063 49/192
2008/0016782 A1 * 1/2008 Balbo Di Vinadio ..... E05D 15/5208 49/506
2017/0362857 A1 * 12/2017 Zaccaria ..... E05B 65/06
2018/0010371 A1 * 1/2018 Zaccaria ..... E05C 9/006

FOREIGN PATENT DOCUMENTS

EP 0592777 A1 * 4/1994 ..... E05D 15/5205
EP 3045634 A1 * 7/2016 ..... E05D 15/30
EP 3045635 A1 * 7/2016 ..... E05D 15/5202
EP 3279417 A1 * 2/2018
EP 3279418 A1 * 2/2018
WO WO-2013135545 A1 * 9/2013 ..... E05C 9/066

* cited by examiner

LEAF UNIT OF A SCISSOR MECHANISM OF A FITTING AND METHOD FOR INSTALLING SUCH A LEAF UNIT

RELATED APPLICATIONS

This application claims priority from European Patent Application No. 16 001 693.7 filed Aug. 1, 2016, which is herein incorporated by reference in its entirety.

FIELD OF THE INVENTION

The invention relates to a leaf unit of a scissor mechanism of a fitting for a leaf of a window or of a door, for insertion into a C-shaped leaf groove in the rebate of a leaf profile of the leaf, having a scissor guide which is to be fastened on the leaf and a scissor rod which is movable relative to the scissor guide in the operating state, wherein the scissor rod is movable between a closed position and a tilt position relative to the scissor guide in the operating state. In addition, the invention relates to a leaf arrangement having a leaf of a window or of a door and having a leaf profile of the leaf which comprises a C-shaped leaf groove in the rebate and having at least one leaf unit of the aforementioned type. Finally, the invention relates to a method for installing, in particular front installing, a leaf unit of the aforementioned type.

BACKGROUND OF THE INVENTION

Fittings are used to actuate a window or door leaf. A fitting, in this case, designates all of the fitting parts which are installed in the rebate of the leaf and are coupled with the fitting gearing. The fitting gearing is connected to a rotary handle which is provided on the outside of the leaf and by means of which the individual fitting parts are actuated. The fitting parts are, for example, strikers, driving rods, toggle latches, corner drives or scissor mechanisms or rather the leaf units thereof, in particular turn-tilt scissors and/or the guides thereof. In this case, the respective fitting parts are arranged in the rebate of the frame of the respective leaf. To this end, in the rebate the leaf profile of the leaf comprises a C-shaped groove in which the individual fitting parts are, as a rule, displaceably arranged and ultimately connected to or coupled with the fitting gearing.

There are two different installation options when installing the fitting parts. One option provides that the individual fitting parts are slid into the end of the C-shaped leaf groove of the frame profile which is open at the end. A disadvantage of said end-side installation is in particular that if it is necessary to replace a fitting part, it is often difficult to do so once the leaf has been installed.

Another installation principle is front installation. In this connection, it is possible to insert, in particular swivel, the individual fitting parts frontally into the groove opening of the C-shaped leaf groove in the rebate of the leaf profile of the leaf. In the case of systems known in practice which use the principle of front installation, however, comparatively large numbers of components are required in order to secure the swivelled-in fitting parts in the swivelled-in position. This makes front installation comparatively expensive.

Irrespective of whether the principle of side insertion or front installation is reverted to, the correct arrangement of the leaf unit of a scissor mechanism in the C-shaped groove in the rebate of the leaf is problematic. The leaf unit, which ultimately consists of two main components, namely the outer scissor guide which is to be fastened on the leaf profile and the inner scissor rod which is displaceable in the C-shaped leaf groove relative to the scissor guide, is to be arranged or rather to be installed at a precisely pre-defined position inside the leaf groove, as the leaf unit of the scissor mechanism is to be connected to the frame profile or rather to a fitting part provided on the frame profile of the outer frame by means of at least one scissor leg. Finally, precisely defined fastening points, on the one hand, on the frame profile or rather on the fitting part provided there and, on the other hand, on the leaf unit of the scissor mechanism which is situated in the leaf, have to be provided for the connection of the scissor leg or legs.

In practice, the correct installation of the scissor mechanism is consequently the cause of a great deal of expenditure.

OBJECT AND SUMMARY OF THE INVENTION

It is the object of the present invention then to provide a leaf unit of the type mentioned in the introduction and a corresponding method for installing such a leaf unit, wherein the installation of the leaf unit of the scissor mechanism is to be made easier.

The abovementioned object is achieved according to the invention in the case of a leaf unit of the type mentioned in the introduction substantially in that the scissor guide and the scissor rod of the leaf unit are pre-fixed for insertion into the leaf groove in a pre-installation position which is between the closed position and the tilt position. The relative mobility or displaceability of the scissor rod relative to the scissor guide which is present in the operating state disappears as a result of the pre-fixing in the pre-installation position. In this way, the two components—scissor guide and scissor rod—can ultimately be handled as one component when installing the leaf unit into the leaf groove such that, as a result, precisely pre-defined points are produced for the connection of the leaf unit to further fitting parts during the final installation of the overall fitting. As a result, the installation is made considerably easier overall due to the prefixing of the two components of the leaf unit which are movable per se—that is to say in the operating state—relative to one another.

In conjunction with the pre-fixed pre-installation position of the two scissor parts, it has been ascertained that it is best during the installation of the leaf unit for the pre-installation position to provide the middle position between the closed position and the tilt position. When the scissor rod is situated in the middle position relative to the scissor guide, the best connection can be effected between the scissor rod and the adjacent driving rod and at the same time, in this case, the correct arrangement of the scissor guide is also ensured for fastening on the leaf profile.

In conjunction with the realization of the prefixing between the scissor guide and the scissor rod, it has been further ascertained that a positive locking connection realized between the two aforementioned components is the most appropriate. Realizing a positive locking connection between the two scissor parts ensures that they do not lose their pre-fixed pre-installation position when the leaf unit is inserted into the leaf groove. It is favorable, in particular, in this context when the positive locking connection comprises at least one fixing journal and a corresponding journal opening for the engagement of the fixing journal. In this case, the fixing journal can be provided either on the scissor guide or, however, on the scissor rod. The journal opening is accordingly realized on the other scissor part opposite the fixing journal.

To eliminate the pre-installation position and consequently also the pre-fixing, it is provided according to the invention that the fixing journal can be sheared off in the case of a (first) relative movement of the scissor rod in relation to the scissor guide. This can be effected, in particular, as a result of a relatively weakly dimensioned fixing journal and/or a predetermined breaking point on the fixing journal.

In conjunction with the fixing journal, which is to be sheared off, it is appropriate to provide the fixing journal on the scissor rod and the journal opening on the scissor guide. Once the fixing journal has been sheared off, the sheared-off journal then remains as necessary in the journal opening of the scissor guide. As a result, the movement of the scissor rod relative to the scissor guide during the actuation of the fitting or rather in the operating state is not impaired.

In the case of an alternative embodiment of the leaf unit named in the introduction, which is appropriate, however, in particular in connection with the previously described embodiment in conjunction with the pre-fixed pre-installation position of the scissor guide and of the scissor rod, it is provided that a mounting head, which comprises a stop, is provided on the end of the scissor guide or of the scissor rod at the end of the leaf. As a result of the mounting head or rather of the stop provided thereon which is provided on the end of the scissor guide or of the scissor rod at the end of the leaf, a precise installation position of the scissor guide or of the scissor rod can be ensured when the leaf unit is inserted into the leaf groove. This applies in particular when, as provided in the case of the previously described embodiment, the pre-fixing of the scissor guide and of the scissor rod is provided.

In conjunction with the mounting head or rather the stop provided on the mounting head, it is obvious that the stop is realized in such a manner that it strikes against the leaf profile outside the leaf groove, the stop is therefore dimensioned in such a manner that it cannot be inserted into the leaf groove. The stop is situated therefore outside the leaf groove during the installation of the leaf unit and in this way ensures the precise arrangement of the scissor rod/scissor guide or rather of the leaf unit inside the leaf groove.

As has been stated previously, the mounting head can be provided with the stop in principle on the scissor rod or the scissor guide. As the scissor guide is actually shorter compared to the scissor rod and the distance between the end of the scissor guide at the end of the leaf and the end of the leaf groove is comparatively large and correspondingly the mounting head with its connecting crosspiece to the scissor guide would have to be relatively long, it is particularly appropriate to provide the mounting head on the scissor rod. As, however, the scissor rod is a fitting part which is movable when the fitting is actuated or rather in the operating state, the mounting head would be in the way once the leaf was installed. For this reason, a predetermined breaking point, which makes it possible to break off the mounting head with corresponding fixing on the leaf once the leaf unit has been installed, is provided at the transition between the mounting head and the scissor rod body.

Apart from this, following the stop, the mounting head, along with the actual head portion which ultimately provides a handle portion for gripping the mounting head, comprises an extension crosspiece for connection to the scissor rod body. The precise arrangement of the leaf unit in the leaf groove can ultimately be ensured by means of the length of the extension crosspiece.

In order to ensure that, once inserted manually into the leaf groove, the leaf unit remains in its position and also does not move out of the leaf groove independently when the leaf unit is loaded, at least one safety element, which is displaceable transversally with respect to the longitudinal direction of the scissor guide relative to the scissor guide body, is provided on the scissor guide for installing the scissor guide in the leaf groove. The safety element ultimately serves for the purpose of filling out the clearance between the leaf unit and the leaf groove necessary for swivelling the leaf unit into the leaf groove or at least to reduce it so much that the leaf unit is prevented from unintentionally rotating or falling out of the leaf groove, at the same time, however, the leaf unit or rather the scissor guide is nevertheless able to be displaced along the leaf groove.

In order to be able to fasten the scissor guide and consequently in the pre-fixed state also the leaf unit as a whole to the leaf or rather to the profile thereof, at least one punch bolt is provided on the scissor guide for fixing the scissor guide on the leaf.

Apart from this, the invention also relates to a leaf arrangement which comprises a leaf of a window or of a door and, apart from this, a leaf unit of the aforementioned type. In this case, the leaf unit is provided and installed in the C-shaped leaf groove in the rebate of the leaf profile. Further components of the scissor mechanism can also be associated with the leaf arrangement along with the leaf unit, in particular scissor legs which are arranged in a preferred manner in a Y form, that is to say in particular with one long and one short scissor leg. In addition, the outer frame, on which the leaf is pivotably mounted in the installed state and to which or to a further fitting part at least one scissor leg of the scissor mechanism is connected in the installed state, can also be associated with the leaf arrangement.

Over and beyond this, the present invention relates to a method for installation, and in particular for front installation, of a leaf unit according to the aforementioned type in a C-shaped leaf groove in the rebate of the leaf profile of a leaf of a window or of a door.

Substantially in conjunction with the installation method is that the leaf unit is inserted into the leaf groove with the scissor guide and the scissor rod in the pre-fixed state. Said insertion can ultimately be effected by sliding in at the side or, however, also by swivelling in at the front. The advantages which are produced by pre-fixing the two scissor parts have already been discussed in the introduction. Reference can be made hereto. As an alternative to this or in addition to the aforementioned aspect, it is provided according to the method that the leaf unit is displaced in the longitudinal direction of the leaf groove until the stop of the mounting head strikes against the end of the leaf profile. A precise and accurately predetermined arrangement of the component connected to the mounting head inside the leaf profile is produced as a result. Reference is once again made to the aforementioned advantages.

In a preferred manner in conjunction with the method according to the invention is that the leaf unit is secured against swivelling out by means of a safety element once it has been inserted, in particular once it has been swivelled, into the leaf groove. The safety means, which serves ultimately for reducing the clearance between the leaf unit and the leaf groove once the leaf unit has been inserted, is consequently slid into the leaf groove transversally with respect to the longitudinal direction of the leaf unit.

For pre-positioning the leaf unit in a precise manner, it is further provided according to the method in the case of a particularly preferred design that the pre-fixed leaf unit is displaced in the longitudinal direction of the leaf groove until the stop of the mounting head strikes against the leaf profile or rather against the end of the leaf groove. Precisely pre-defined positioning of the leaf unit, that is to say of both the scissor guide and of the scissor rod, is ultimately achieved in this way. In particular, immediately following the aforementioned positioning of the stop at the end of the leaf groove, the scissor guide is fixedly installed on the leaf with the leaf unit in the pre-fixed state. This is preferably effected by at least one punch bolt which is to be inserted into the profile of the leaf.

Once the scissor guide has been installed, the mounting head is broken off such that the mounting head which serves purely for positioning purposes does not get in the way of the movement of the fitting.

To eliminate the pre-fixed state between the scissor guide and the scissor rod, it is provided according to the invention that once the fitting has been installed and when it is actuated for the first time and consequently when the scissor rod is moved relative to the scissor guide for the first time, the fixing journal is sheared off. This can be realized in particular with the corresponding choice of material for the fixing journal and for the associated scissor part, which can consist, for example, of die-cast zinc, with corresponding dimensioning of the fixing journal and/or by at least one predetermined breaking point, in particular at the transition between the fixing journal and the associated scissor part.

BRIEF DESCRIPTION OF THE DRAWING

Further features, advantages and application possibilities of the present invention are produced from the following description of exemplary embodiments by way of the drawing and from the drawing itself. In this case, all described and/or graphically represented features, on their own or in arbitrary combination, form the object of the present invention, irrespective of their summary in the claims or of the priority reference thereof.

The drawings are as follows.

DETAILED DESCRIPTION OF THE EMBODIMENTS

Figure 1:
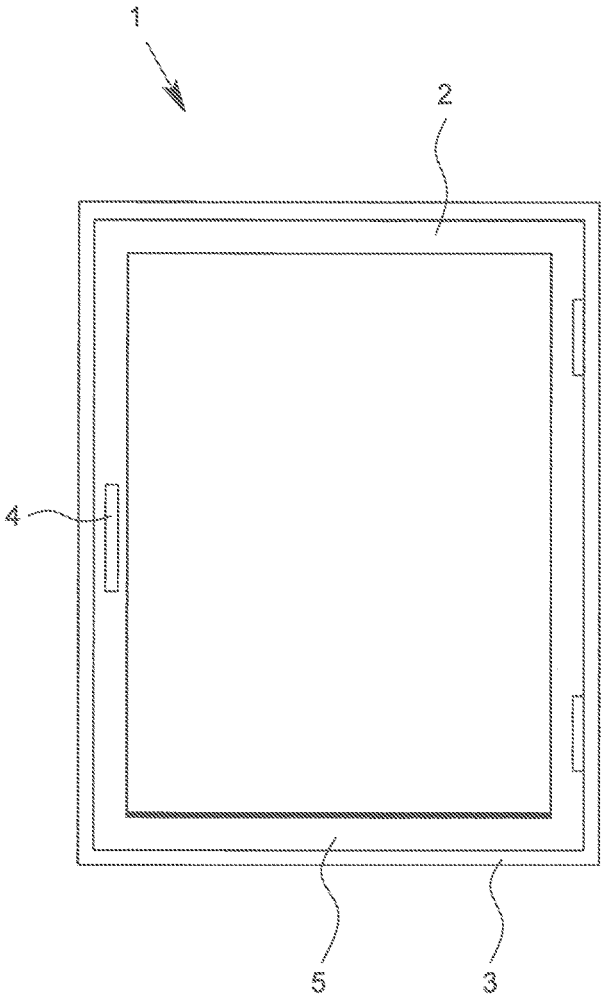
FIG. 1 shows a front view of a leaf arrangement.
Figure 2:
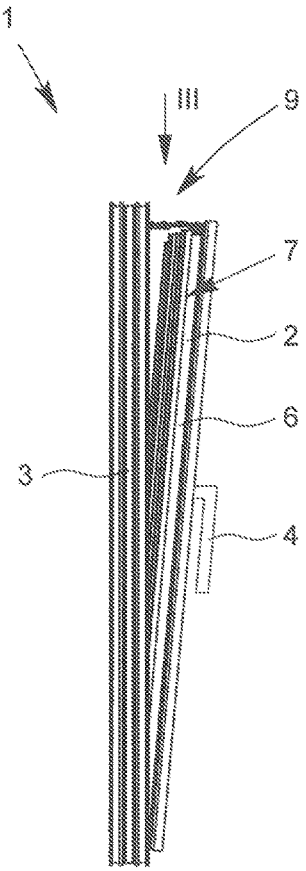
FIG. 2 shows a side view of the leaf arrangement in FIG. 1 with the leaf tilted.
Figure 3:
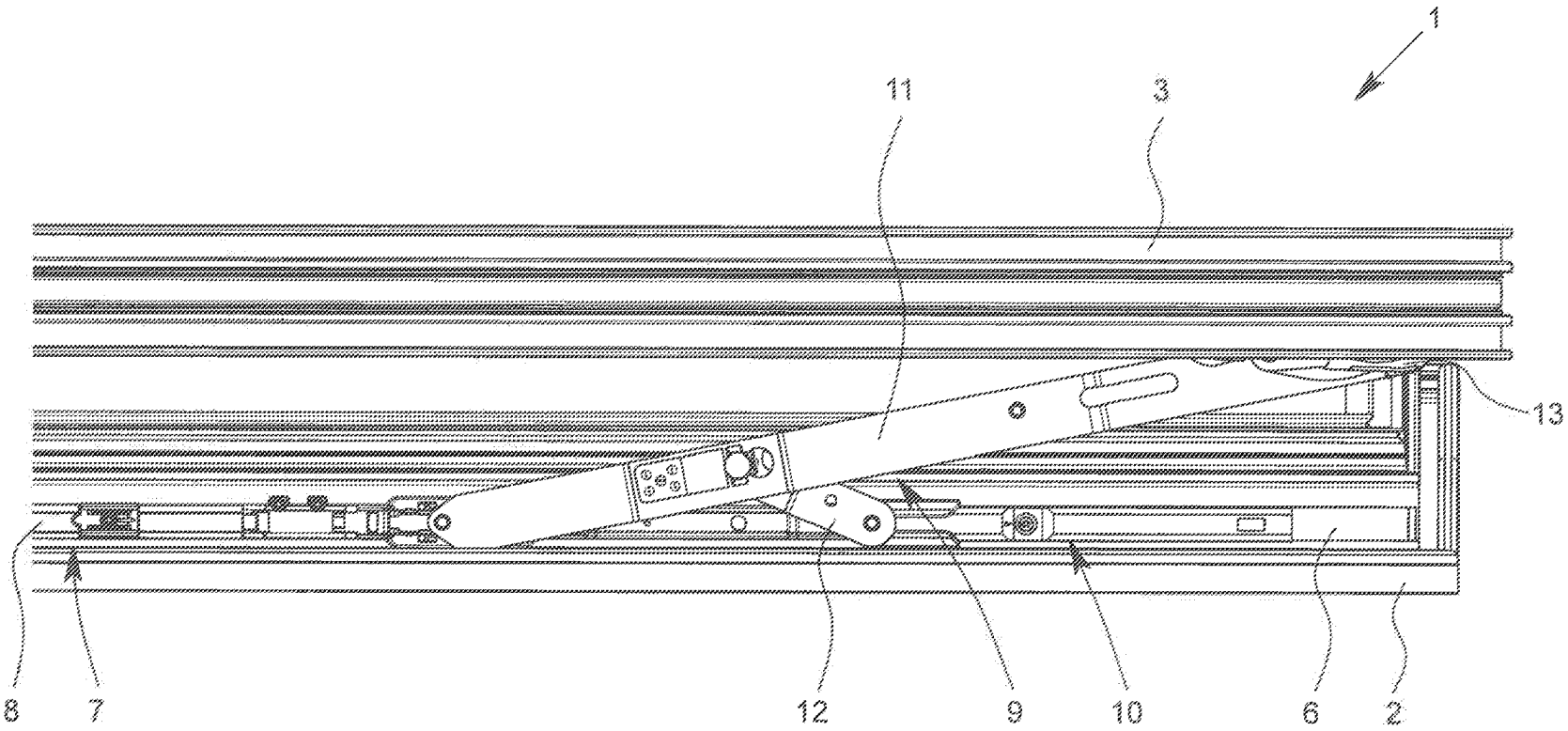
FIG. 3 shows a view of the leaf arrangement in FIG. 2 when seen in the direction of arrow III in FIG. 2.

FIG. 1 shows a leaf arrangement 1 with a leaf 2 of a window. The leaf 2 is mounted on a frame 3 so as to be pivotable. A handle 4, which is rotatable about 180° from the vertically orientated position shown, serves for opening and closing the leaf 2. The handle 4 interacts with a fitting gear, not shown, which interacts, in turn, with a fitting. The leaf 2 comprises a circumferential leaf profile 5 which comprises a C-shaped leaf groove 6 which is open toward the frame 3. The leaf groove 6 is arranged in the rebate 7 of the leaf profile 5 of the leaf 2.

Figure 19:
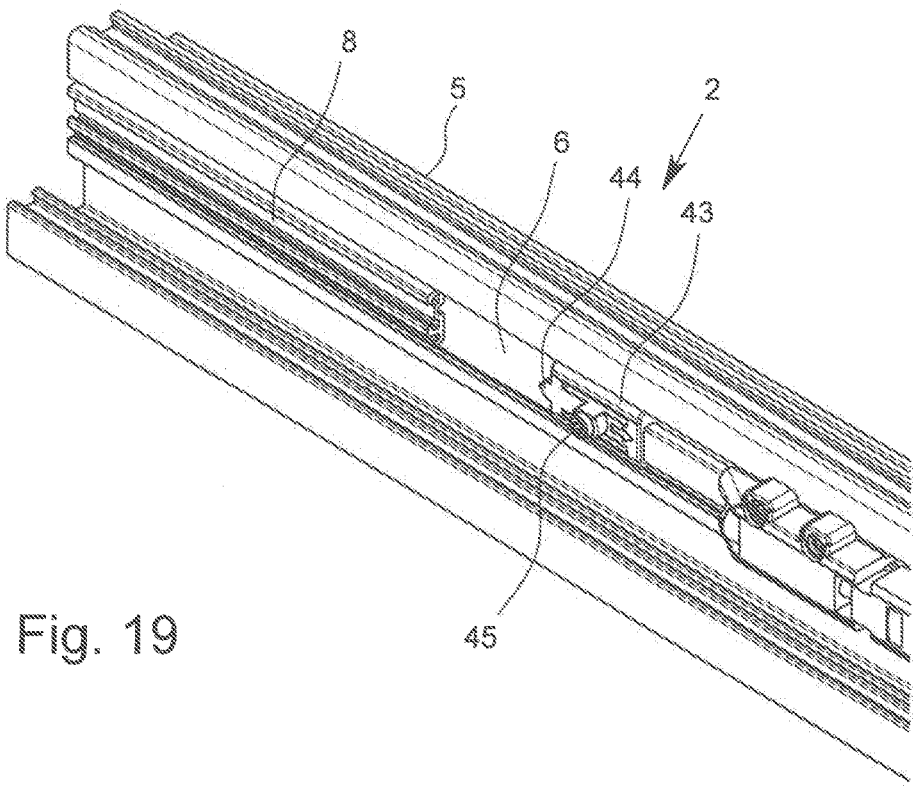
FIG. 19 shows a view of part of the leaf arrangement with a driving rod inserted.

The fitting, which consists of a plurality of fitting parts and extends over a fairly large region of the rebate 7 of the leaf profile 5, comprises at least one driving rod 8, as is shown, for example, in FIG. 19, at least one corner drive (not shown), at least one striker (not shown) and apart from this a scissor mechanism 9. The scissor mechanism 9 comprises, in turn, a leaf unit 10, a scissor leg 11 which extends between the leaf unit 10 and the frame 3 and a further scissor leg 12 which connects the scissor leg 11 and the leaf unit 10. The scissor leg 11 is mounted at its one end on the leaf unit 10 so as to be pivotable and longitudinally displaceable, whilst it is mounted at its other end on a fitting part 13 of the frame 3 so as to be rotatable. The further scissor leg 12 is mounted on the scissor leg 11 and on the leaf unit 10 so as to be rotatable in each case.

Figure 4:
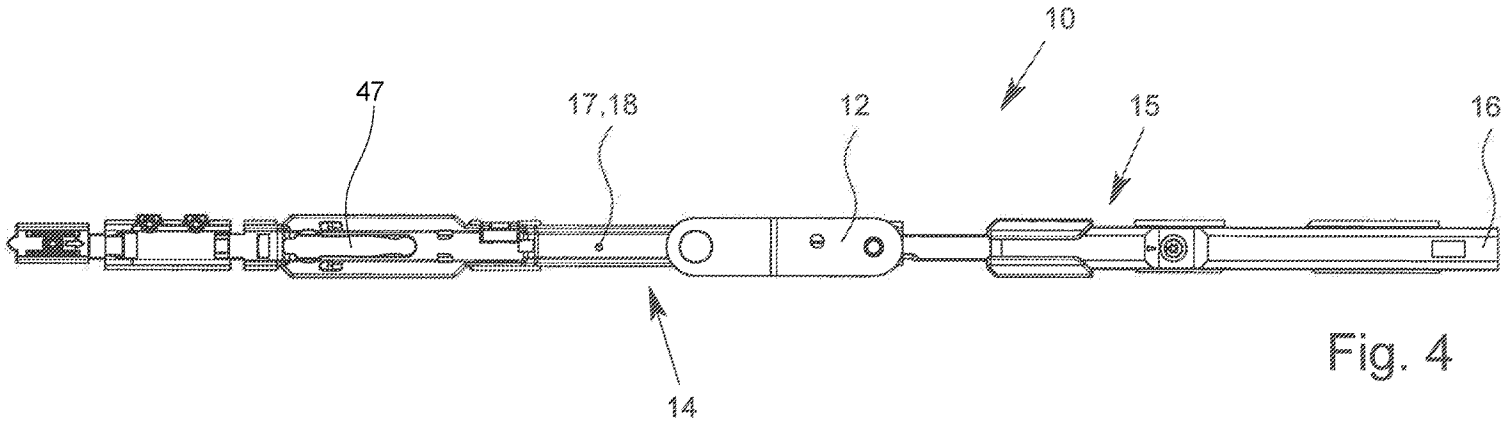
FIG. 4 shows a top view of a leaf unit according to the invention in the closed position.
Figure 5:
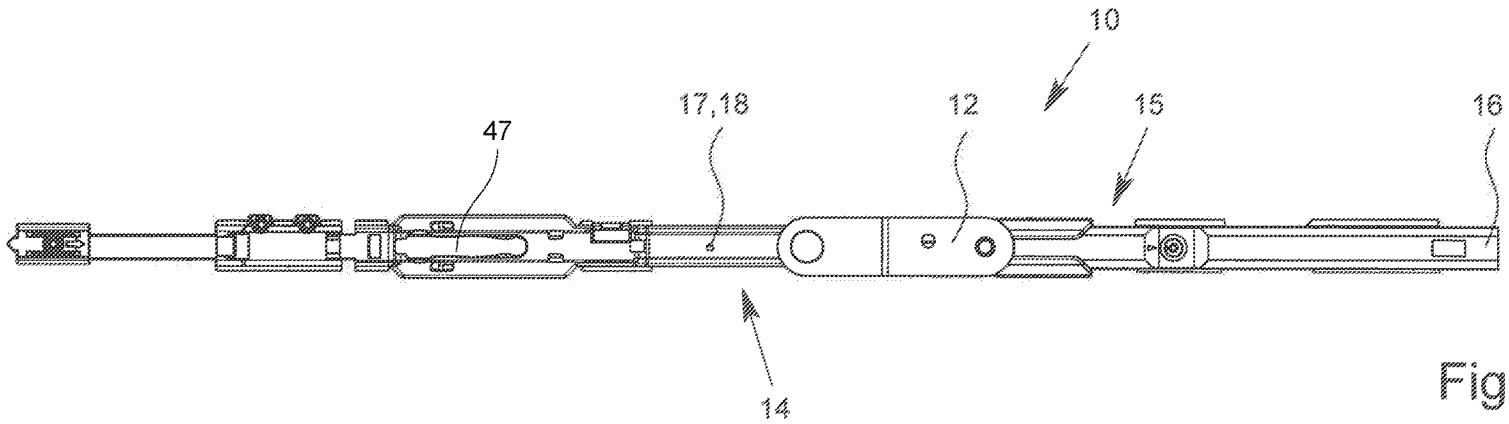
FIG. 5 shows a top view of the leaf unit in FIG. 4 in the tilted position.
Figure 6:
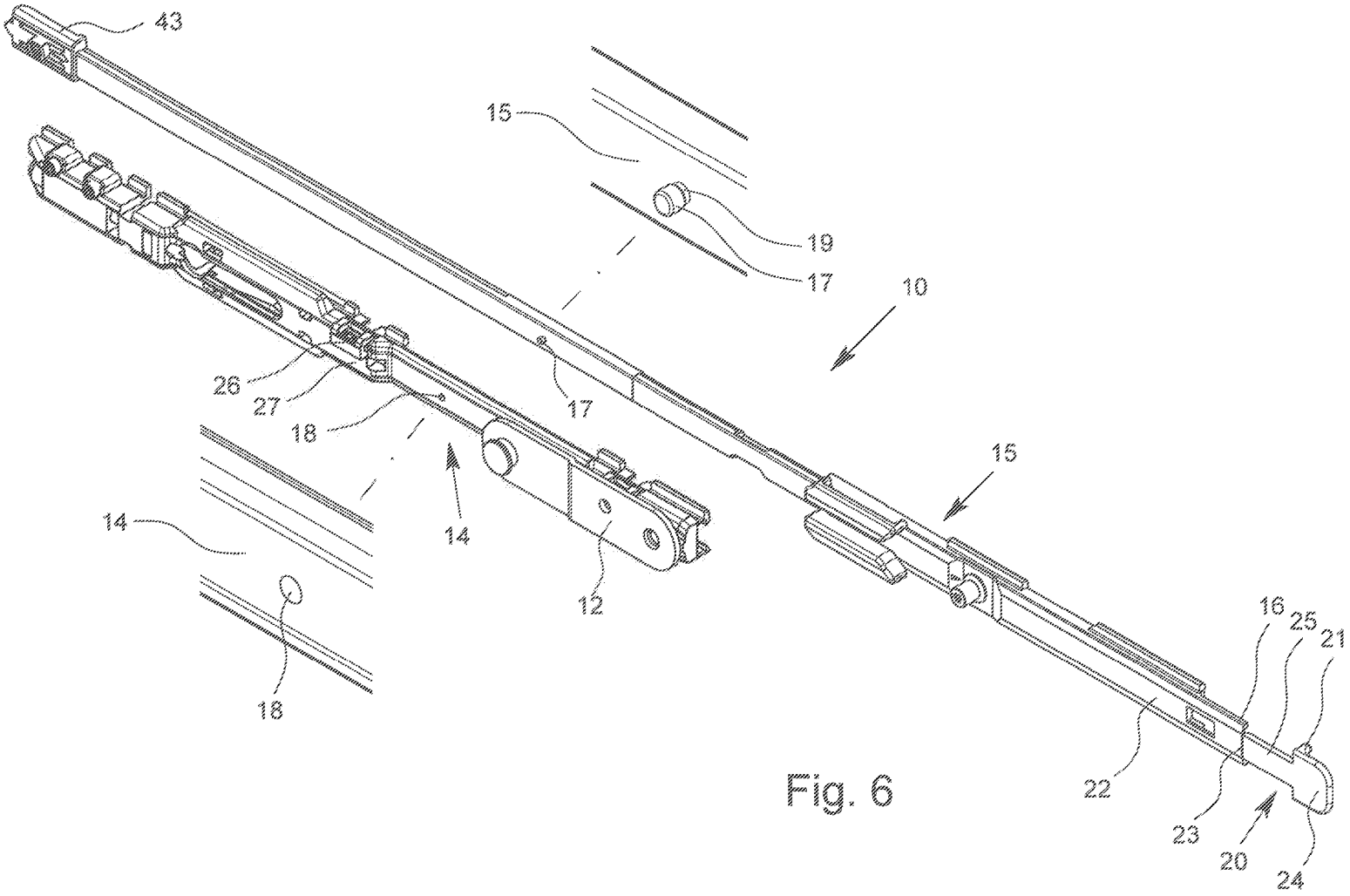
FIG. 6 shows an exploded representation of the leaf unit in perspective with the scissor guide and the scissor rod and an enlarged view of a detail of the scissor parts.

The leaf unit 10 as such, shown in FIG. 4 in the closed position and in FIG. 5 in the tilt position, comprises, as can be seen in particular in FIG. 6, a scissor guide 14, which is to be fastened on the leaf 2 or rather leaf profile 5 in the region of the leaf groove 6, and a scissor rod 15 as main components. In the operating state, when, therefore, the leaf unit 10 is arranged in the leaf groove 6 on the leaf 2, is connected to the further fitting parts and is actuatable by means of the handle 4, the scissor rod 15 is movable relative to the scissor guide 14 fastened on the leaf 2 or rather is displaceable in the longitudinal direction. The two end positions, into which the scissor rod 15 is movable in the longitudinal direction in the operating state, are shown in FIGS. 4 and 5. In the closed position shown in FIG. 4, the end 16 of the scissor rod 15 at the end of the leaf is further away from the scissor guide 14 than is the case in the tilt position shown in FIG. 5. In both positions, the position of the scissor guide 14 is unchanged as it is fastened on the leaf 2. Apart from this, it can be seen, in particular in FIGS. 4 to 6, that the further scissor leg 12 is mounted on the scissor guide 14. A bearing slot 47 is provided on the scissor guide 14 for the turn-move bearing arrangement of the scissor leg 11.

Figure 7:
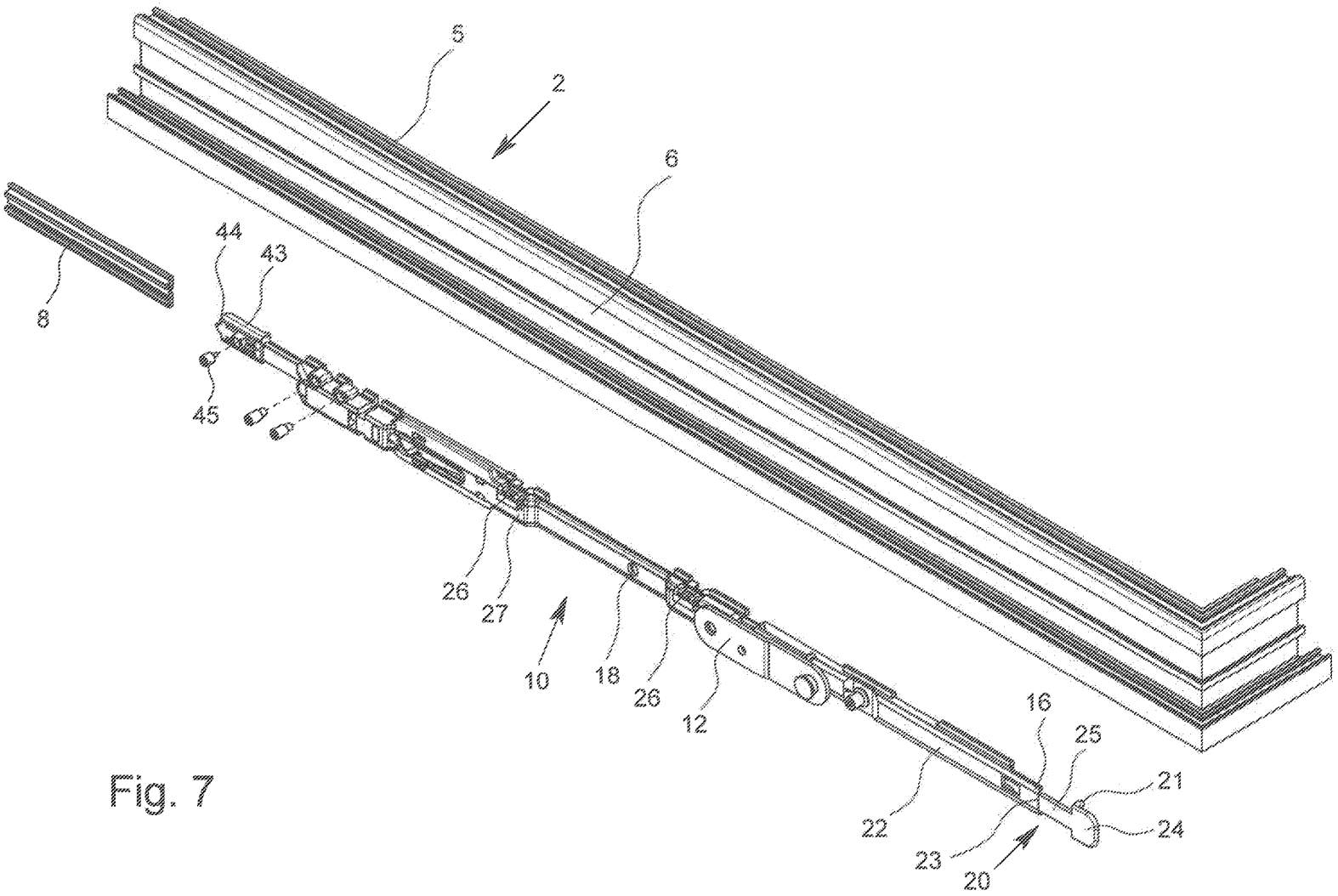
FIG. 7 shows a perspective representation of different components of the leaf arrangement.
Figure 8:
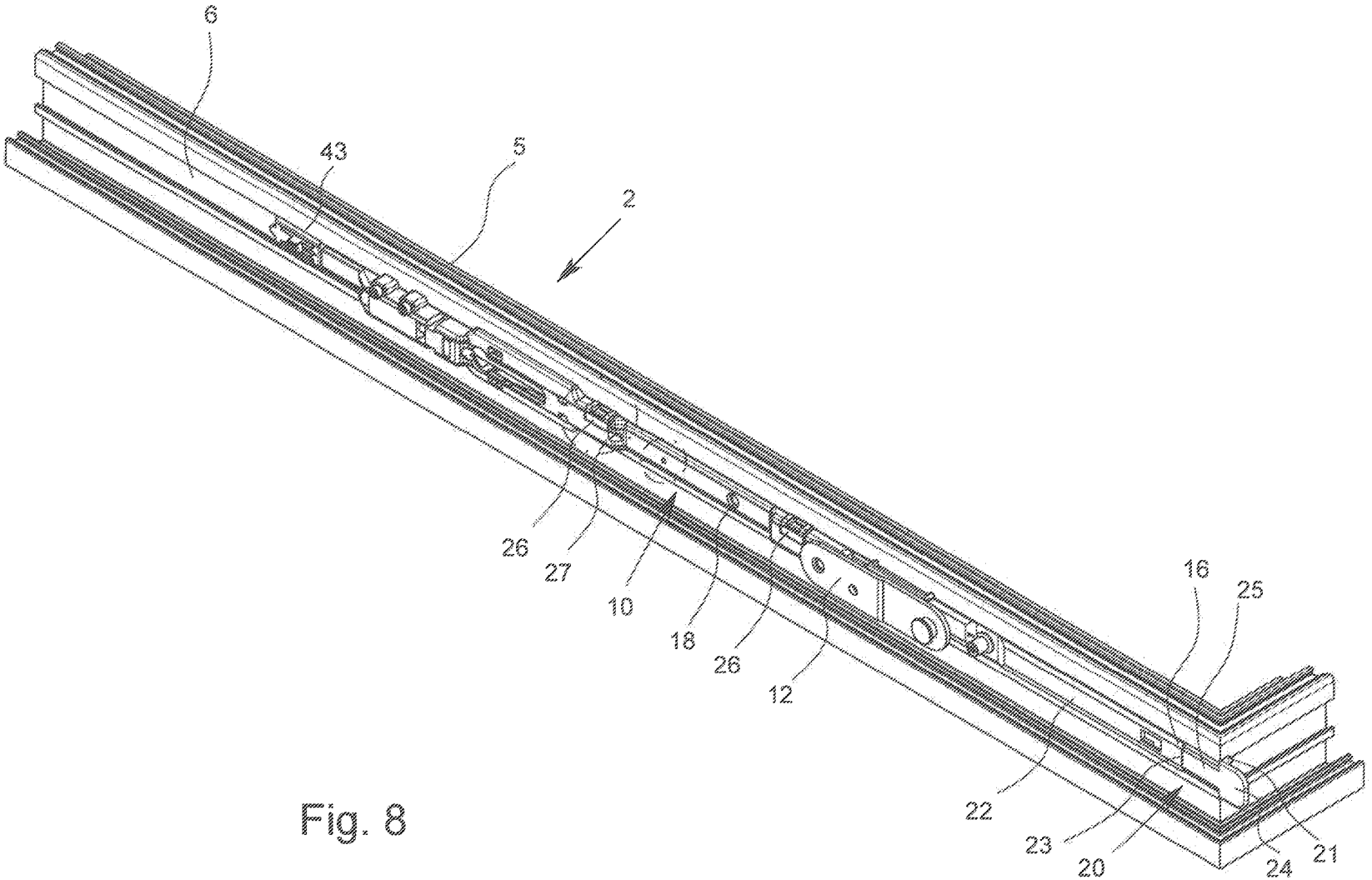
FIG. 8 shows a perspective representation of the leaf unit inserted into the leaf groove of the leaf.

In conjunction with the leaf unit 10, it is provided then that the scissor guide 14 and the scissor rod 15 are pre-fixed in a pre-installation position between the closed position and the tilt position prior to the first-time use and prior to insertion into the leaf 2. The pre-installed state is shown in particular in FIGS. 7 and 8. In the present case, the pre-installation position provides the middle position between the closed position and the tilt position. The scissor rod 15 is movable out of the pre-installation position by half the distance between the closed position and the tilt position relative to the scissor guide 14. As a rule, this is a section of between 1 cm and 3 cm where an overall distance between the closed position and the tilt position is between 2 cm to 6 cm. A conventional distance between the closed position and tilt position is approximately 3.8 cm.

In the case of the embodiment shown, the pre-fixing is designed as a positive locking connection between the scissor guide 14 and the scissor rod 15. In the present case, the positive locking connection here comprises a fixing journal 17 and a journal opening 18 which is provided and designed for the engagement of the fixing journal 17. In this case, the fixing journal 17 is situated on the side of the scissor rod 15 facing the scissor guide 14, whilst the journal opening 18 is provided on the scissor guide 14. This is shown in particular in FIG. 6 and in the pre-fixed state in FIG. 12. Apart from this, it can be seen in particular in FIGS. 6 and 12 that the fixing journal 17 has a predetermined breaking point 19 at the transition to the scissor rod 15. The predetermined breaking point 19 ensures that the fixing journal 17 is sheared off when the scissor rod 15 is moved in relation to the scissor guide 14 for the first time.

As a further aspect for the correct positioning of the leaf unit 10 when it is being installed in the leaf groove 6, the scissor rod 15 comprises, on its leaf-side end 16, a mounting head 20, on which a stop 21 is provided. In the case of the exemplary embodiments shown, the mounting head 20 with the stop 21 is provided in combination with the pre-fixing or rather with the positive locking connection. However, it must be pointed out explicitly that the mounting head 20 with the stop 21 can also be realized in principle without any pre-fixing of the leaf unit 10. In addition, it is also possible in principle not to provide the mounting head 20 on the scissor rod 15, but rather on the scissor guide 14. This would mean, however, the realization of a relatively long mounting head 20 as the scissor guide 14 is ultimately clearly shorter than the scissor rod 15.

In order to be able to sever the mounting head 20 in a simple manner, a predetermined breaking point 23 is provided at the transition between the mounting head 20 and the scissor rod body 22. The mounting head 20 itself comprises three components per se, namely a head portion 24, the stop 21 and an extension crosspiece 25 following the stop 21. The head portion 24 serves ultimately to aid manual gripping of the mounting head 20, in particular when breaking it off. The stop 21 assumes the stop function and ensures that the head portion 24 including the stop 21 is arranged outside the leaf groove 6 when the leaf unit 10 is installed. The extension crosspiece 25 ensures the precise positioning of the leaf unit 10 or rather, in the case of the embodiment shown, of the scissor rod 15 and consequently also of the pre-fixed scissor guide 14.

In the case of the embodiment shown, two safety elements 26, which serve for installing the scissor guide 14 or rather the leaf unit 10, are provided on the scissor guide 14. Each safety element 26 is displaceable transversally with respect to the longitudinal direction of the scissor guide 14 relative to the scissor guide body 27. The function or rather the specific design of each safety element 26 is explained in more detail below in conjunction with the installation of the leaf unit 10.

In addition, two punch bolts 28, which serve for fixing the scissor guide 14 on the leaf 2 or rather leaf profile 5 in the region of the leaf groove 6, are provided on the scissor guide 14. This is also described in more detail below.

FIGS. 9 to 12 will be elaborated on below in conjunction with the front installation of the leaf unit 10 in the leaf groove 6 of the leaf profile 5 of the leaf 2, the following description relating not only to method features but also to features of the object.

Figure 9:
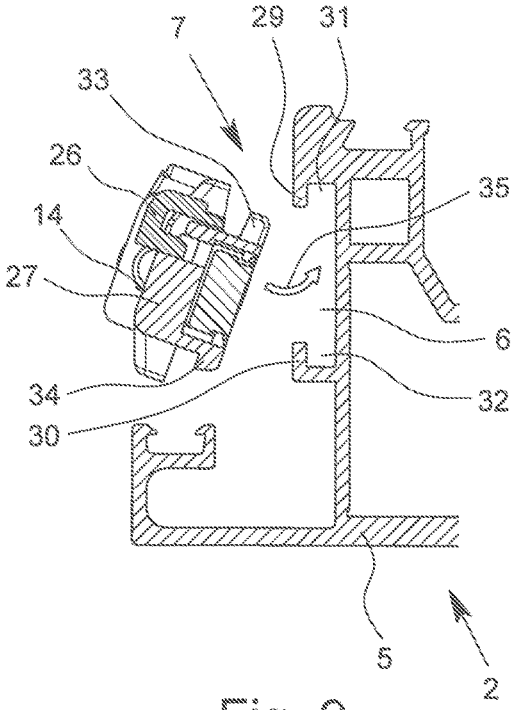
FIGS. 9-11 show cross sectional views when the leaf unit is swivelled into the leaf profile.
Figure 10:
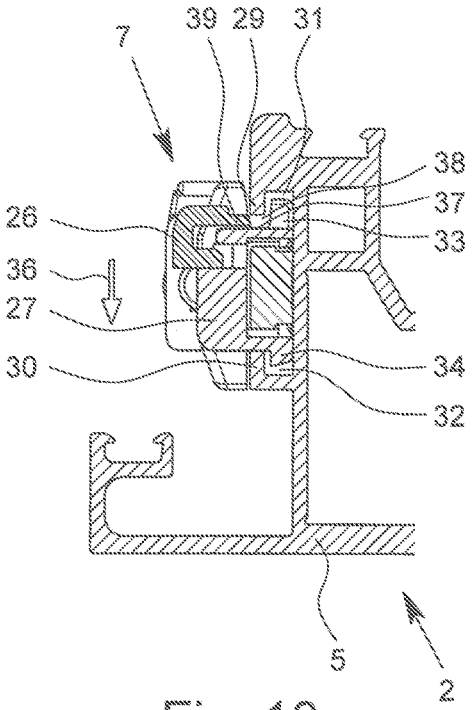
Figure 12:
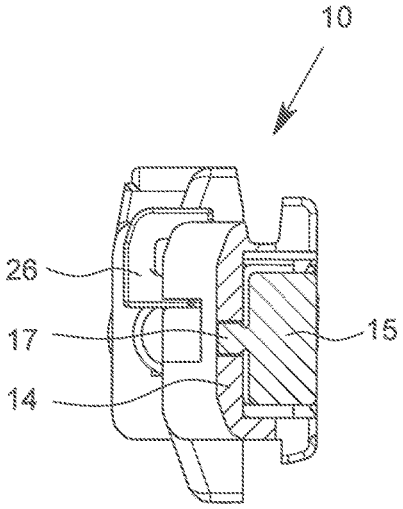
FIG. 12 shows a cross sectional view of the leaf unit in the region of the positive locking connection between the scissor guide and the scissor rod.

The leaf profile 5 or rather the form of the leaf groove 6 can be seen in particular in FIG. 9. It comprises two groove legs 29, 30 which are located opposite one another and behind which groove portions 31, 32 are provided. The scissor guide 14 comprises a shoulder 33, 34 on each of its longitudinal edges, which are located opposite one another, both shoulders being provided for engaging behind the groove portions 29, 30 and for insertion into the groove portions 31, 32. The leaf unit 10, in the pre-fixed state as shown in FIG. 12, is swivelled into the leaf groove 6 corresponding to the movement arrow 35. In this case, the shoulder 33 engages behind the groove leg 29 and passes into the groove portion 31. The clearance distance between the groove legs 29, 30, in this case, is such that the shoulder 34 is able to swivel past the groove leg 30.

Figure 11:
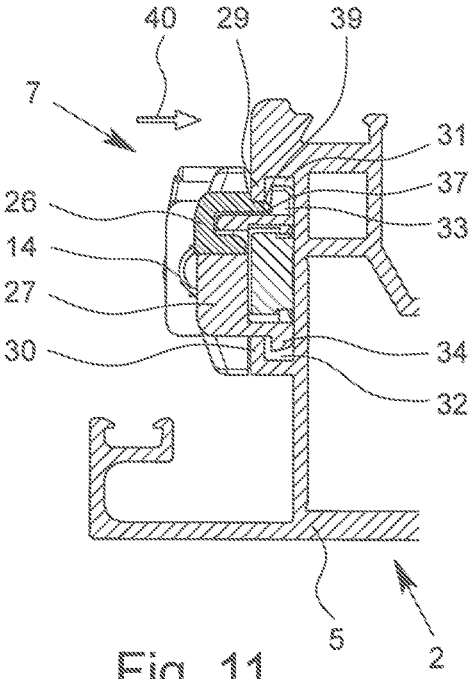

Once swivelled in corresponding to FIG. 9, the leaf unit 10 is lowered inside the leaf groove 6, as shown by the movement arrow 36. As a result of the lowering, a space 38 is produced between the groove bottom 37 behind the shoulder 33 and the end of the oppositely situated groove leg 29. The safety element 26 with a fill leg 39 is slid into said space 38 in the direction of the movement arrow 40, as shown in FIG. 11. In said secured state, the scissor guide 14 and consequently also the leaf unit 10 cannot rotate independently out of the leaf groove 6 even under load. Nevertheless, displacement of the leaf unit 10 in the longitudinal direction of the leaf groove 6 is easily possible.

Figure 13:
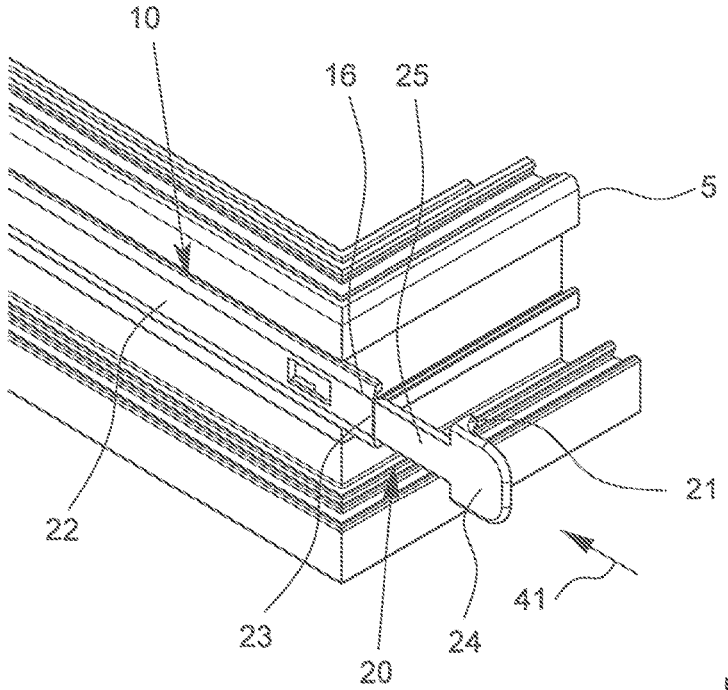
FIG. 13 shows a view of the leaf unit inserted into the leaf groove in the state not yet positioned correctly.
Figure 14:
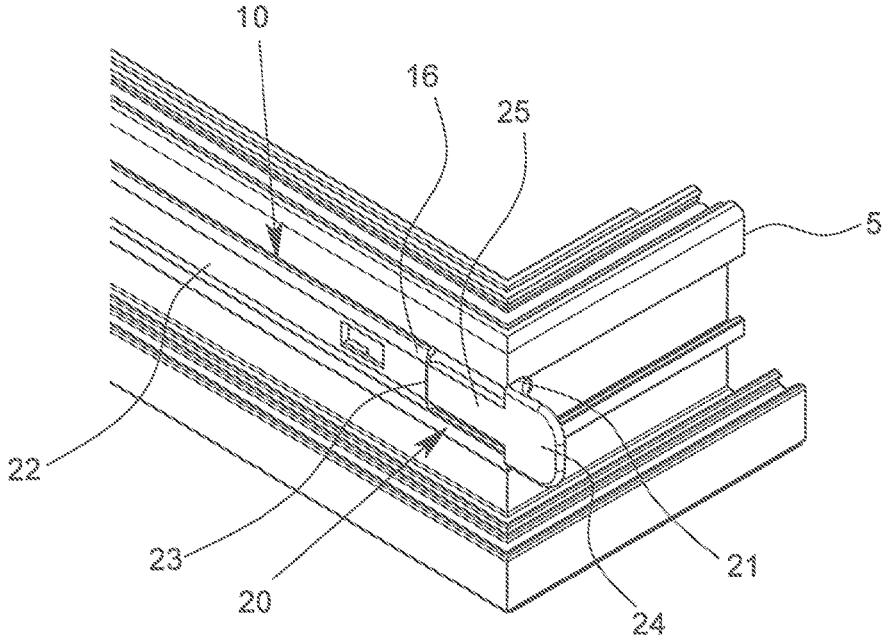
FIG. 14 shows a view corresponding to FIG. 13 of the leaf unit in the correctly positioned state.

As the mounting head 20 cannot be swivelled into the leaf groove 6 in particular on account of the size of the head portion 24 and, apart from this, on account of the stop 21, the swivelling-in is effected such that at least the head portion 24 and the stop 21 are situated outside the leaf groove 6. Such a state is shown in FIG. 13. For precise positioning of the leaf unit 10, the leaf unit 10 is then displaced in the direction of the movement arrow 41 such that the state shown in FIG. 14 is produced, which is also shown, apart from this, in FIG. 8.

For the sake of completeness, it can be noted at this point that it is also possible, in principle, also to slide the leaf unit 10 as a whole into the leaf groove 6 laterally instead of the previously described swivelling-in by way of front installation. In this connection too, the state which is shown in FIGS. 13 and 14 or rather 8 can then be ultimately achieved.

Figure 15:
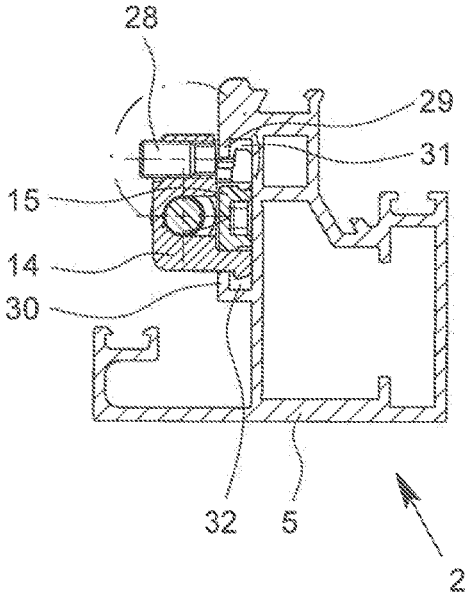
FIG. 15 shows a cross sectional view of the leaf arrangement in the region of a punch bolt in the non-fastened state.
Figure 16:
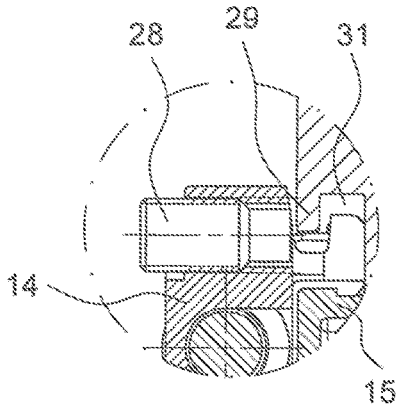
FIG. 16 shows a view of a detail in FIG. 15.
Figure 17:
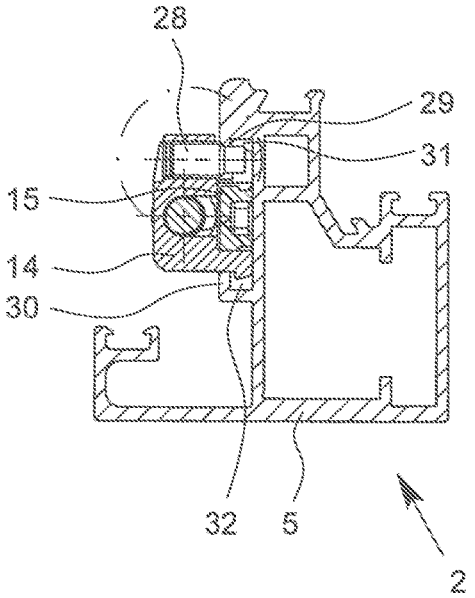
FIG. 17 shows a view corresponding to FIG. 15 in the fastened state.
Figure 18:
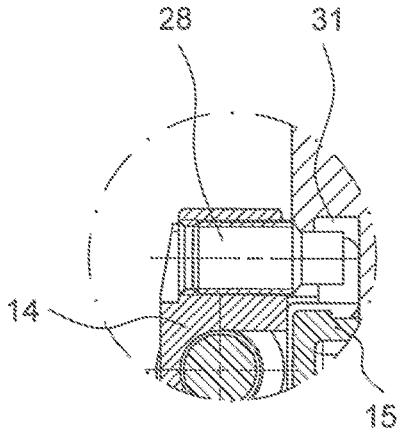
FIG. 18 shows a view of a detail of the representation in FIG. 17.

In this state, in which the leaf unit 10 is situated as such in a precisely predefined position inside the leaf groove 6 and also the scissor guide 14 and the scissor rod 15 are situated in the pre-fixed state and consequently relative to one another in a predefined position, the leaf unit 10 is fixed as a result of inserting the punch bolts 28 into the leaf profile 5. In this case FIGS. 15 and 16 show the state prior to tightening the punch bolts 28, whilst FIGS. 17 and 18 show the state in which the punch bolts 28 are already inserted into the leaf profile 5 in the region of the leaf groove 6. The insertion is effected in the region of the groove leg 29 such that punched-out material drops into the region of the groove portion 31. During the insertion of the punch bolts 28, the leaf unit 10 or rather the scissor guide 14 is held under tension in a preferred manner manually, thereby ensuring that the leaf unit in the pre-fixed state is fastened in the leaf groove 6 actually in the predefined position 10.

The mounting head 20 can then be broken off and the connection between the leaf unit 10 and the driving rod 8 can be undertaken. The order in which this occurs is arbitrary.

Figure 20:
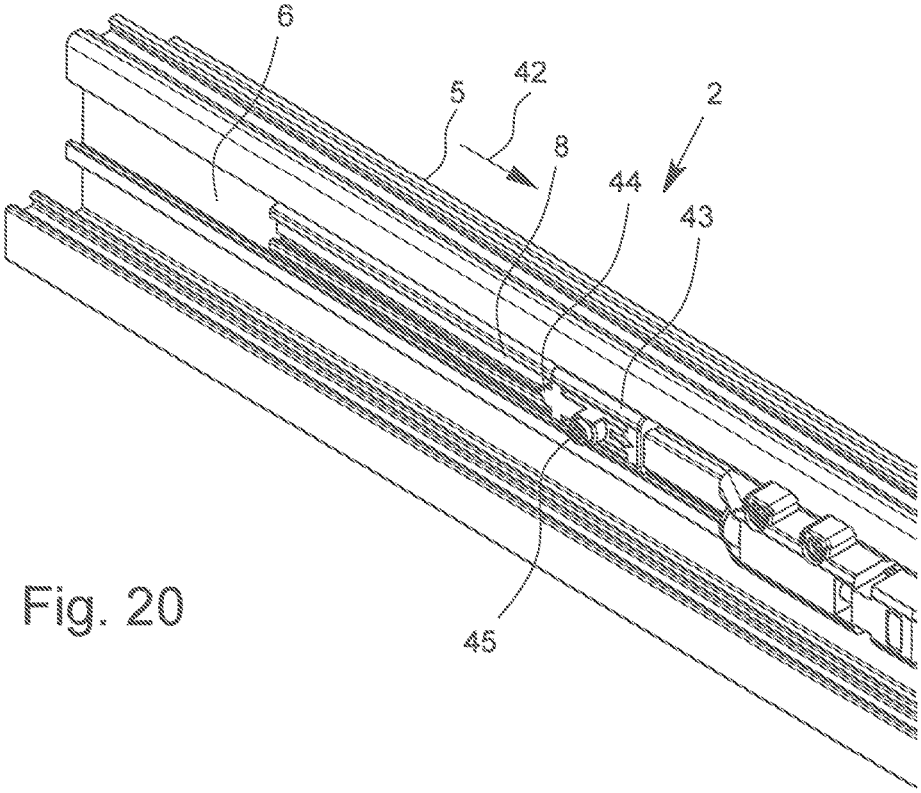
FIG. 20 shows a view corresponding to FIG. 19 with the driving rod displaced in the direction of the leaf unit.

FIG. 19 shows a state in which the driving rod 8 has already been inserted into the leaf groove 6. Even if this is not clear from the drawing, the driving rod 8 has also been swivelled into the leaf groove 6. Once the driving rod 8 has been inserted into the leaf groove 6, it is displaced in the direction of the movement arrow 42 and consequently in the direction of the leaf unit 10, as can be seen in FIG. 20.

Figure 21:
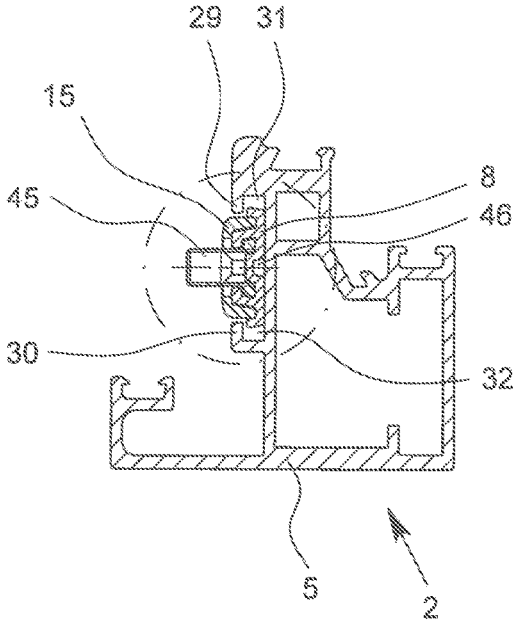
FIG. 21 shows a cross sectional view of a connecting body of the leaf unit in the state not yet connected to the driving rod.
Figure 22:
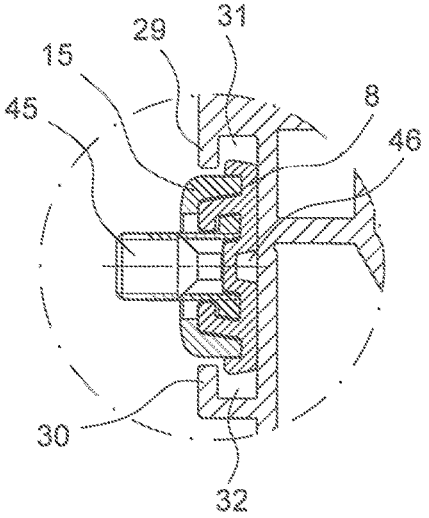
FIG. 22 shows a view of a detail in FIG. 21.
Figure 23:
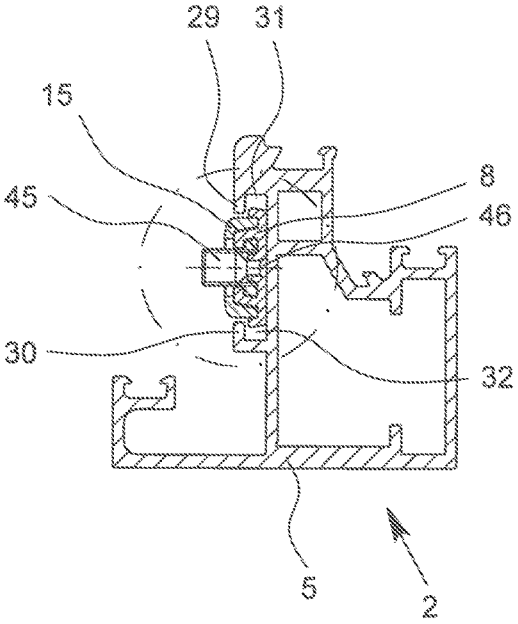
FIG. 23 shows a view corresponding to FIG. 21 with the driving rod connected and FIG. 24 shows a view of a detail in FIG. 23.
Figure 24:
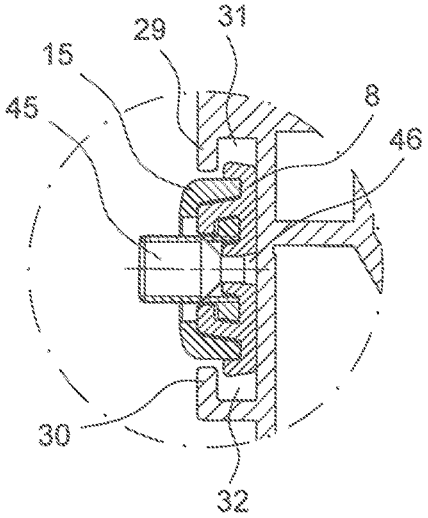

The connection between the driving rod 8 and the leaf unit 10 is effected by means of a connecting body 43 which is provided on the other end of the scissor rod 15. The connecting body 43 comprises an end-side projection 44 which tapers in the direction of the driving rod 8 and consequently facilitates the movement of the driving rod 8 in the direction of the connecting body 43 or rather the coupling of the two parts. Apart from this, a punch bolt 45, which serves for connecting the connecting body 43 to the driving rod 8, is provided in the connecting body 43. In this case, FIGS. 21 and 22 show the state in which the punch bolt 45 has not yet been inserted. FIGS. 23 and 24 show the state in which the punch bolt 45 is inserted into the driving rod 8 such that a fixed connection is produced between the connecting body 43 and consequently the leaf unit 10 or rather the scissor rod 15 and the driving rod 8. The punched-out material arising when the punch bolt 45 is inserted is received in a space 46 which is realized beneath the driving rod 8.

1 Leaf arrangement
2 Leaf
3 Frame
4 Handle
5 Leaf profile
6 Leaf groove
7 Rebate
8 Driving rod
9 Scissor mechanism
10 Leaf unit
11 Scissor leg
12 Further scissor leg
13 Fitting part
14 Scissor guide
15 Scissor rod
16 End
17 Fixing journal
18 Journal opening
19 Predetermined breaking point
20 Mounting head
21 Stop
22 Scissor rod body
23 Predetermined breaking point
24 Head portion
25 Extension crosspiece
26 Safety element
27 Scissor guide body
28 Punch bolt
29 Groove leg
30 Groove leg
31 Groove portion
32 Groove portion
33 Shoulder
34 Shoulder
35 Movement arrow
36 Movement arrow
37 Groove bottom -continued 38 Space
39 Fill leg
40 Movement arrow
41 Movement arrow
42 Movement arrow
43 Connecting body
44 Projection
45 Punch bolt
46 Space
47 Bearing slot

The invention claimed is:

1. A leaf unit of a scissor mechanism of a fitting for a leaf of a window or of a door, insertable into a C-shaped leaf groove in a rebate of a leaf profile of the leaf, comprising a scissor guide fastenable on the leaf, and a scissor rod movable relative to the scissor guide in an operating state; wherein the scissor rod is movable between a closed position and a tilt position relative to the scissor guide in the operating state; and wherein the scissor guide and the scissor rod are pre-fixed for insertion into the leaf groove in a pre-installation position which is between the closed position and the tilt position.

2. The leaf unit according to claim 1, wherein the pre-installation position is a middle position between the closed position and the tilt position.

3. The leaf unit according to claim 1, wherein the pre-fixing is realized as a positive locking connection between the scissor guide and the scissor rod.

4. The leaf unit according to claim 3, wherein the positive locking connection comprises at least one fixing journal and one journal opening to engage the fixing journal.

5. The leaf unit according to claim 4, wherein the fixing journal is shearable in response to a relative movement of the scissor rod in relation to the scissor guide.

6. The leaf unit according to claim 5, wherein the fixing journal comprises a predetermined breaking point.

7. The leaf unit according to claim 1, further comprising a mounting head comprising a stop provided on an end of the scissor guide or of the scissor rod at an end of the leaf.

8. The leaf unit according to claim 7, further comprising a predetermined breaking point provided at a transition between the mounting head and a body of the scissor rod or of the scissor guide; and wherein the mounting head comprises an extension crosspiece to connect the stop to the body of the scissor rod and of the scissor guide.

9. The leaf unit according to claim 7, wherein the mounting head comprises an extension crosspiece to connect the stop to a body of the scissor rod or of the scissor guide.

10. The leaf unit according to claim 7, further comprising at least one safety element, which is displaceable transversally with respect to a longitudinal direction of the scissor guide relative to the body of the scissor guide, provided on the scissor guide to install the scissor guide in the leaf groove; and at least one punch bolt on the scissor guide to fix the scissor guide on the leaf.

11. The leaf unit according to claim 7, further comprising at least one punch bolt on the scissor guide to fix the scissor guide on the leaf.

12. A leaf arrangement comprising a leaf of a window or of a door; a leaf profile of the leaf comprising a C-shaped leaf groove in a rebate; and at least one leaf unit of a scissor mechanism of a fitting according to claim 1.

13. A method for front installing a leaf unit of a scissor mechanism of a fitting according to claim 7 in the C-shaped leaf groove in the rebate of the leaf profile of the leaf of the window or of the door, comprising a step of swivel inserting the leaf unit into the leaf groove in the pre-fixed state.

14. The method according to claim 13, further comprising a step of displacing the leaf unit in the leaf groove in a longitudinal direction until the stop of the mounting head strikes against an end of the leaf profile.

15. The method according to claim 13, further comprising, after the step of swivel inserting the leaf unit into the leaf groove, a step of securing the leaf unit against swivelling out by a safety element which is displaceable relative to the scissor guide.

16. The method according to claim 13, further comprising a step of installing the scissor guide fixedly on the lead profile with the leaf unit in a pre-fixed state.

17. The method according to claim 14, further comprising, after the step of installing the scissor guide, a step of breaking off the mounting head.

18. The method according to claim 13, further comprising, after an installation of the fitting and actuation of the fitting for a first time, a step of shearing off a fixing journal providing a positive locking connection between the scissor guide and the scissor rod in response to a relative movement of the scissor rod in relation to the scissor guide.

* * * * *